United States Patent [19]

Benedetto

[11] 4,336,443

[45] Jun. 22, 1982

[54] MODULAR BAKE OVEN FOR DRYING VARNISHED ELECTRICAL COMPONENTS

[76] Inventor: Joseph M. Benedetto, 2059 Maybank Hwy., Charleston, S.C. 29412

[21] Appl. No.: 227,284

[22] Filed: Jan. 22, 1981

[51] Int. Cl.[3] ..... F27D 11/02

[52] U.S. Cl. ..... 219/400; 34/231; 126/21 A; 219/368; 219/370; 219/386; 432/76

[58] Field of Search ..... 219/368, 369, 370, 385, 219/386, 400, 524, 525; 34/60, 202, 231; 126/21 A; 432/76, 141, 238; 13/22, 32; 99/340, 427, 447; 53/557

[56] References Cited

U.S. PATENT DOCUMENTS

| | | | |
|---|---|---|---|
| 906,251 | 12/1908 | Meek | 432/238 |
| 1,135,267 | 4/1915 | Dieckmann | 432/76 |
| 1,352,893 | 9/1920 | Guice | 118/43 |
| 1,426,059 | 8/1922 | Froelich | 432/141 |
| 2,466,349 | 4/1949 | Anderson | 99/340 |
| 2,466,409 | 4/1949 | Gardes | 219/368 |
| 2,483,787 | 9/1948 | Sheraski | 432/76 |
| 3,786,162 | 1/1974 | Colson | 13/22 |
| 4,121,091 | 10/1978 | Warcham | 219/400 |
| 4,162,604 | 7/1979 | Bartocomei | 53/557 |
| 4,295,034 | 10/1981 | Assmann | 219/400 |
| 4,295,419 | 10/1981 | Laughammer | 99/427 |

*Primary Examiner*—Volodymyr Y. Mayewsky
*Attorney, Agent, or Firm*—Richard S. Sciascia; Harvey A. David

[57] ABSTRACT

A modular oven device for baking rewound and varnished electrical components of substantial size includes front and rear oven sections, sized to pass individually through a passageway too narrow to accommodate the component to be baked, and assembled on a base section to define an oven cavity, and a heater/blower section assembled on one oven section. The oven sections are characterized by double, unsulated walls, flanges covering joints, a thermostatic control, and inlet and exhaust air flow regulation.

10 Claims, 4 Drawing Figures

MODULAR BAKE OVEN FOR DRYING VARNISHED ELECTRICAL COMPONENTS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates generally to the field of ovens for subjecting objects to an elevated temperature for a prolonged period for the purpose of baking or cure drying coatings, such as varnish on electrical windings, or the like.

More particularly, the invention is directed to a novel, modular, varnish baking oven that is particularly suited to drying varnish or varnish-like coatings on stators or other components of electrical machinery that are difficult to remove to a remote location because of their size and configuration. For example, at times it becomes necessary to rewind the stators of rather large electrical generators used on submarines or other vessels having hatchways or access openings that are smaller than will permit passage of the components to be rewound. In these circumstances, it has been necessary either to cut an opening in the hull of the submarine or vessel large enough to remove the component to a workshop, or to rewind and varnish the component on board. The former expedient poses obvious disadvantages of cost, time, and possible loss of hull strength after repair, while attempts at the latter expedient have been notably unsatisfactory because of a lack of suitable means for baking the necessary varnish coatings on the new windings. Efforts to effect baking of the varnish with infra-red or heat lamps and jury rigged enclosures have produced poor results and windings of uncertain reliability.

A variety of oven devices that can be assembled from portable components have been devised for various purposes including drying of paints or varnishes on automobiles as taught by U.S. Pat. No. 1,352,893 to W. O. Guice. That device includes a plurality of rectangular side wall sections and top wall sections adapted to be clamped together for forming an oven enclosure around an automobile, and having an electric heater, a blower, and conduits for forcing heated air into the oven. Other ovens, for example gas fired baking ovens, have been constructed from sections designed for convenience of shipping from the point of manufacture. Examples of these are found in U.S. Pat. No. 906,251 to G. B. Meek and U.S. Pat. No. 1,426,059 to M. Froehlich.

While each of the foregoing structures meets the particular needs of the use for which it was designed, none are well suited to the peculiar situation of baking a rewound and varnished 30 KW stator on board a submarine, for example, having hatchways the diameters of which are too small to permit removal of the stator. The preferred varnish curing procedure calls for initial heating of the varnish dipped stator coupled with a substantial air flow to carry away vapors, followed by baking with a reduced air flow for a predetermined time period at a temperature in a predetermined range. This process may be repeated for successive coats.

Because the submarine itself is substantially closed and is usually occupied by crew or yard personnel, it is necessary that the on board baking be accomplished without undue heating of the workspace concerned or polution of the air therein with possibly toxic vapors. Accordingly, it is desirable to provide an oven that is well insulated and which provides for efficient controls for temperature and air flow therethrough.

SUMMARY OF THE INVENTION

With the foregoing in mind, it is a principal object of this invention to provide a novel construction that satisfies a need for an electrical component varnish baking or curing oven which can be carried aboard a submarine or other vessel having hatchways that are smaller than will permit removal of the electrical component to be baked.

Another object of this invention is the provision of an oven device for baking or curing varnish on electrical stators or other large components, which device is adapted to be separated into a plurality of smaller modules or sections for transport through passageways of restrictive size, and which can be easily reassembled without tools.

Yet another object is to provide an oven device of the foregoing character which is inexpensive to construct and operate, light in weight, and particularly effective in maintaining controlled temperature and air flow conditions in its interior.

As another important object, the invention aims to provide a component baking oven of modular construction wherein assembly of the component modules is facilitated by interfitting of parts so constructed that they are self aligning and require mere actuation of simple latches to maintain assembled relation.

The invention may be further said to reside in certain novel constructions, combinations, and arrangements of the various parts by which the foregoing objects and advantages are achieved, as well as others which will become apparent from the following detailed description when read in conjunction with the accompanying sheets of drawings.

DESCRIPTION OF THE PREFERRED EMBODIMENT

Figure 1:
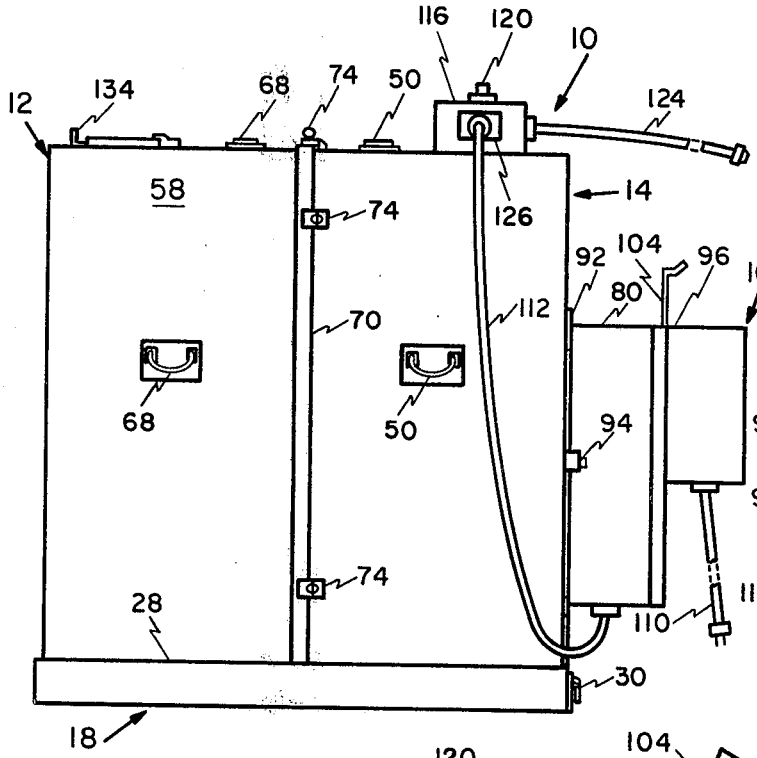
FIG. 1 is a side elevational view of an electrical component varnish baking oven embodying the invention.

In the form of the invention illustrated in the drawings and described hereafter, an oven is indicated generally at 10 and is assembled from four separable modules or sections including a front oven section 12, a rear oven section 14, a heater and blower section 16, and a base or pan section 18. The assembled oven 10 is generally in the shape of a rectangular box within which an electrical component, such as a rewound and varnished stator, can be enclosed and subjected to elevated temperatures and air flow so as to dry or cure the varnish.

Figure 3:
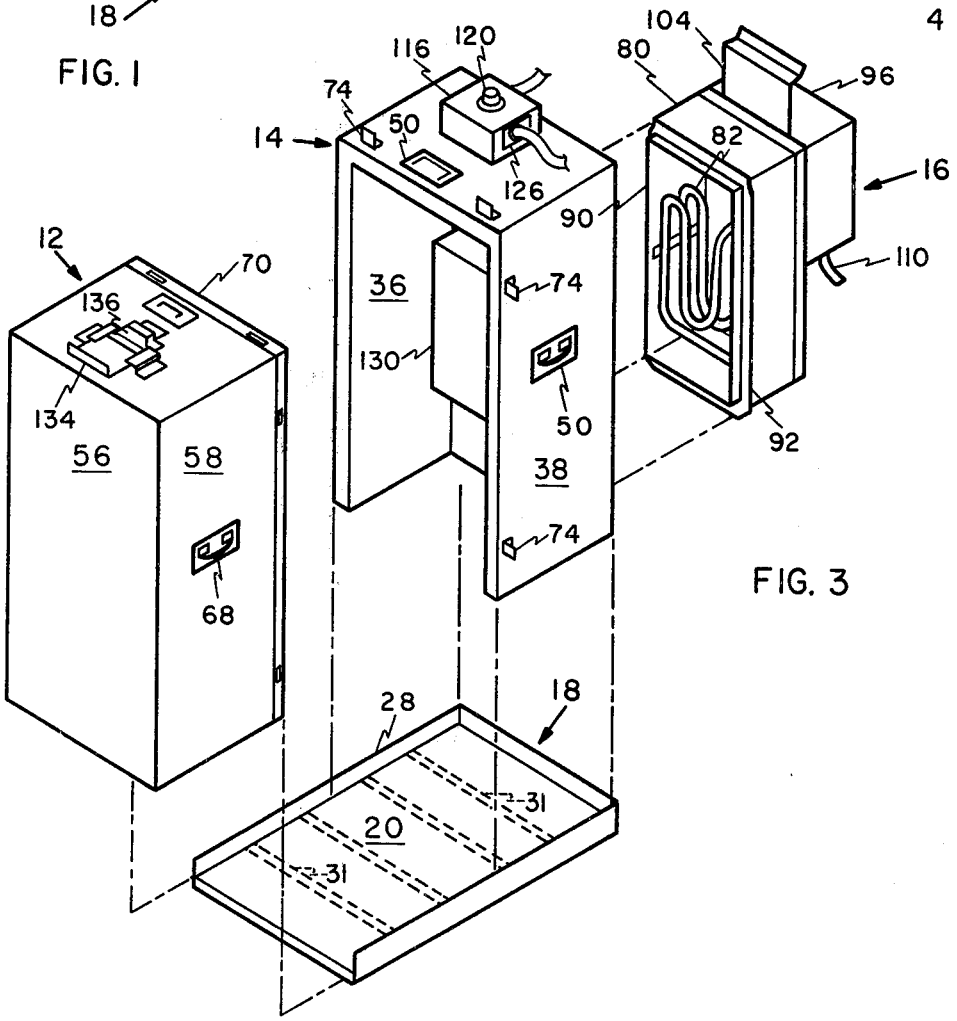
FIG. 3 is a perspective view of the oven illustrating modular sections thereof in disassembled relation.
Figure 4:
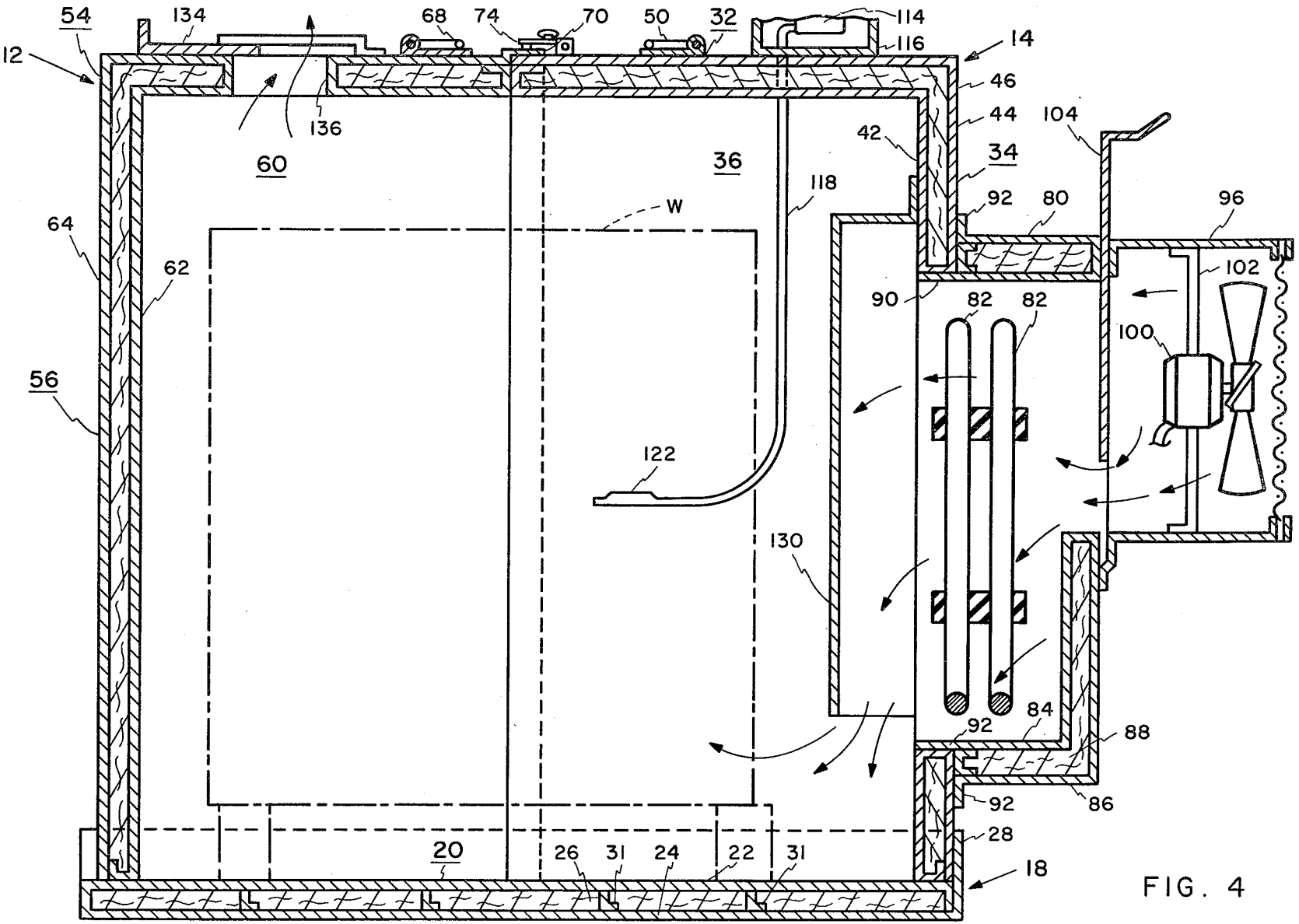
FIG. 4 is a fragmentary enlarged sectional view of the oven taken substantially along line 4—4 of FIG. 3.

Referring particularly to FIGS. 3 and 4, the base or pan section 18 comprises a double bottom wall 20 formed of inner and outer sheet metal layers 22 and 24 with a layer 26 of heat resistant insulation therebetween. Throughout the construction, the preferred sheet metal is aluminum, and the insulation is a non-flammable material such as fiberglass, rockwool, or the like. The pan section, which is rectangular in plan, further comprises an upstanding flange 28 extending above the double bottom wall 20 around three of the four sides thereof, the front, narrow side being left open. The other, or closed, narrow side is provided with a folding carrying handle 30. A plurality of transversely extending, rigid metal angle members 31 are provided between the inner and outer sheet metal layers 22, 24, and serve as stiffening and support means to bear the load of the front and rear oven sections, as well as of the stator or other workpiece shown in phantom at W. The workpiece W is conveniently supported on suitable blocks 33 to assure air circulating space below it.

The rear oven section 14 is also of double wall construction and includes a top wall 32, rear wall 34, and side walls 36, 38, the bottom being open. These double walls of the rear section 14 are formed of inner and outer sheet metal layers 42 and 44 with a layer 46 of insulation therebetween. The oven section 14 is adapted to fit neatly within the flange 28 of the base or pan section 18, with the lower edges of the rear oven section resting on the bottom wall 20. Folding handles 50 are provided at the sides and top of the section 14 for carrying purposes.

The front oven section 12 is of similar double wall construction having a top wall 54, front wall 56, and side walls 58, 60, the bottom being open. These double walls are formed of inner and outer sheet metal layers 62 and 64 with a layer 66 of insulation therebetween. The oven section 12 is adapted to fit neatly between the side portions of the flange 28 of the pan section 18, with the lower edge of the oven section 12 resting on the bottom wall 20. Folding handles 68 are provided on the side and top walls of the section 12, as shown.

The front oven section 12 is further provided with a peripheral lip or flange 70 along the free vertical edges of the side walls 58, 60, and the free horizontal edge of the top wall 54. This flange 70 is adapted to overlie mating, complementary peripheral edge portions of the rear oven section 14 when the sections are assembled as in FIG. 1. Such assembly is facilitated by first placing the rear section 14 on the pan section 18, then placing the front section 12 on the pan section and slightly spaced from the rear section as will be permitted be permitted by the open side of flange 28. The front section can then be slid rearwardly, guided by the flange 28, until the sections are abutted with the lip or flange 70 closing over the joint.

A plurality of cam actuated latches 74 of a suitable commercially available variety are provided along the edges of the oven sections 12 and 14 and serve to draw and secure the sections tightly together.

Figure 2:
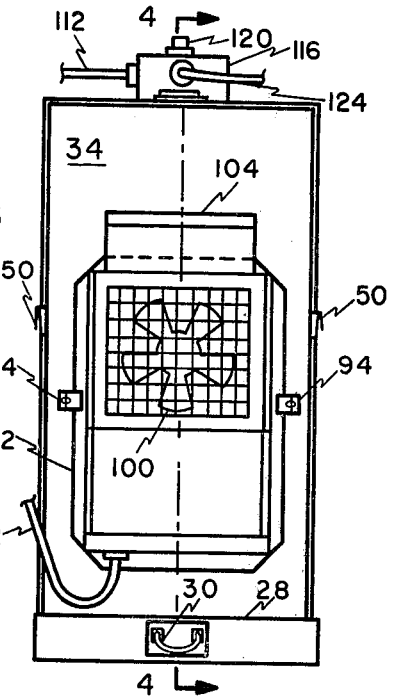
FIG. 2 is a rear elevational view of the oven of FIG. 1.

The heater and fan section 16 comprises a rectangular, double walled housing 80 for electrical resistance type of heating elements 82. The walls of the housing 80 are formed of inner and outer sheet metal layers 84, 86 and an intermediate layer 88 of insulation, as illustrated in FIG. 4. A flange 90 projects forwardly from the housing 80 and is adapted to extend into a rectangular opening 92 through the rear wall 34 of the rear oven section 14. A laterally extending flange 92 is adapted to fit flush against the back wall 34 when the section 16 is secured in its assembled condition of FIGS. 1 and 2 by latches 94.

The section 16 further comprises a blower housing 96 extending rearwardly from the heating element housing 80, and houses an electric fan type of blower 100, supported by suitable brackets 102. An air inlet damper 104 is slidably disposed between the blower housing and heating element housing to adjustably control the flow of air induced by the blower 100 to flow over the heating elements and into the interior of the oven 10.

Suitable electrical power cords 110 and 112 supply current to the blower 100 and heating element 82, respectively. The current for energizing the heating elements 82 is regulated by a thermostatic control unit 114 housed in a suitable box 116 conveniently mounted on the top wall 32 of the rear oven section 14. The control unit 114 may be of a conventional oven control type having a temperature sensing capillary tube 118 and a temperature selecting control knob 120. The capillary bulb 122 is positioned at the mid portion of the side wall 36. The thermostatic control unit 114 is supplied with electrical current via a line cord 124, and controls the power supplied to a receptacle 126 for the power supply cord 112 for the heating elements.

On the inside of the back wall 34 of the rear oven section 14 is secured an air deflection duct or baffle 130. This duct or baffle is closed at the top and sides, and open at the lower end which terminates a short distance above the pan wall 20. Air forced past the inlet damper 104 is heated by the elements 82 and discharged into the lower regions of the oven interior.

The forward oven section 12 is provided with an air exhaust damper 134 that is slidably disposed on the upper surface of the top wall 54 to adjustably control the flow of air from the interior of the oven 10 through an opening 136 in that wall.

In the embodiment 10 being described and which is particularly useful in baking rewound and varnished 30 KW stators of submarines having hatchways typically on the order of 25 inches in diameter, the front oven section 12 has outside dimensions of 18"×18"×36", the rear oven section 14 has dimensions of 17"×18"×36", the base section 18 has dimensions of 18.5"×35"×3", and the heater and blower section 16 has dimensions of about 18"×12"×14". The insulated walls each have a nominal thickness of one inch. The thermostatic control 114 and heating elements 82 are selected from commercially available units to provide and maintain a substantially constant temperature in the oven chamber of about 302° F.±10°.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A modular oven device for baking electrical components located in a workspace having an access passageway of predetermined dimensions less than will pass said oven device when assembled, said oven device comprising in combination:

a rectangular base section having a thermally insulated bottom wall and an upstanding flange extending vertically above said bottom wall along three sides thereof, a fourth side being free of said flange;

first and second thermally insulated oven sections, each comprising first and second vertical side walls, an end wall, and a top wall, said first and second oven sections being disposed with complementary edges of said side and top walls in abutting relation and having their lower edges resting on said bottom wall within said upstanding flange so as to define a workpiece receiving oven chamber;

said edges of one of said oven sections having lip means overlying the line of abuttment with said complementary edges of the other thereof;

a heater and blower section mounted on the end wall of one of said oven sections and comprising a thermally insulated heater element housing, a blower housing, heating element means within said heater element housing, blower means within said blower housing, and an inlet air flow control means disposed between said housings and adapted to regulate air flow through said housings and into said chamber;

said other of said oven sections having an exhaust air outlet opening defined in said top wall thereof;

an exhaust air flow control means mounted on said other of said oven sections and adapted to regulate the air flow out of said chamber; and said first and second oven sections, said base section, and said heater and blower section being separable from each other for transportation through said passageway and reassembly together within said workspace.

2. A modular oven device as defined in claim 1, and wherein:

said side, end, and top walls of said first and second oven sections, said bottom wall of said base, and the walls of said heater housing are each formed of spaced, inner and outer sheet metal layers and an intermediate layer of heat resistant insulation material.

3. A modular oven device as defined in claim 2, and wherein:

said inlet air flow control means and said exhaust air flow control means each comprise a manually positionable damper mounted for sliding movement through a plurality of flow modulating positions relative to said outlet opening.

4. A modular oven device as defined in claim 3, and further comprising:

a plurality of latch means for releasably securing said first and second oven sections together and for releasably securing said heater and blower section to said one of said oven sections.

5. A modular oven device as defined in claim 4, and wherein:

said bottom wall of said base section further comprises a plurality of transverse rib members disposed between said inner and outer sheet metal layers thereof, said rib members being operative to transmit loading forces from a workpiece in said chamber to a supporting surface on which said oven device rests.

6. A modular oven device as defined in claim 5, and wherein:

the end wall of said one oven section is characterized by a through opening of predetermined configuration, said heater housing is disposed in registration with said opening and comprises a first flange extending into said opening and a second flange extending laterally from said heater housing and disposed against the outer surface of said end wall around said opening.

7. A modular oven device as defined in claim 6, and wherein:

said heating element means comprises an electrical resistance heating element and said blower means comprises an electric motor driven fan.

8. A modular oven device as defined in claim 7, and further comprising:

duct means, mounted in said one oven section and disposed in predetermined spaced relation to said end wall thereof so as to cause heated inlet air entering through said opening in that wall to be deflected downwardly into the lower regions of said cavity.

9. A modular oven device as defined in claim 8, and further comprising:

a thermostatic control means, mounted on said one oven section and adapted to control energization of said heater element so as to maintain the temperature in said chamber within a predetermined range of temperatures.

10. A modular oven device as defined in claim 9, and wherein:

said oven sections and said base section are provided with handle means for use in said transportation thereof and in positioning thereof during assembly.

* * * * *